United States Patent [19]

Ihlen

[11] 4,102,063

[45] Jul. 25, 1978

[54] SKI-BOOT

[75] Inventor: Jacob Ihlen, Brandbu, Norway

[73] Assignee: Alfa Skofabrik A/S, Brandbu, Norway

[21] Appl. No.: 766,008

[22] Filed: Feb. 7, 1977

[30] Foreign Application Priority Data

Apr. 30, 1976 [NO] Norway ..... 761495

[51] Int. Cl.[2] ..... A43B 5/04; B62B 0/00

[52] U.S. Cl. ..... 36/117; 280/624

[58] Field of Search ..... 36/117, 118, 119, 120, 36/121, 25 R; 280/11.35 R, 11.35 D, 11.35 K, 11.35 T, 11.35 H, 11.35 Y, 11.35 C, 615, 625, 624

[56] References Cited

U.S. PATENT DOCUMENTS

| | | | |
|---|---|---|---|
| 3,955,825 | 5/1976 | Kubelka et al. | 36/117 |
| 3,957,280 | 5/1976 | Turnheim et al. | 36/117 |
| 3,984,124 | 10/1976 | Gertsch | 36/117 |

*Primary Examiner*—Patrick D. Lawson

*Attorney, Agent, or Firm*—Burns, Doane, Swecker & Mathis

[57] ABSTRACT

In order to relieve the stress on a sole of a ski-boot, which in use is fastened into a toe-binding on a cross-country ski, and in order to give the boot a certain freedom of movement, the underside of the sole in the area in front of the binding attachment is bevelled upwards from the underside.

3 Claims, 4 Drawing Figures

SKI-BOOT

Figure 1:
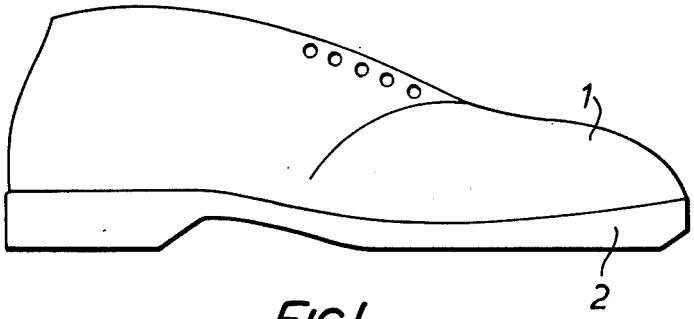

The invention relates to an improvement of a boot sole for ski-boots which are used in connection with ski-bindings of the toe-type. Accordingly the invention relates in particular to a new shaping of the sole of the boot.

Ski-boots for use with cross-country skis or racing skis which are equipped with toe-bindings have relatively flexible soles which make for freedom of movement, when used both with and without skis. The sole bends when the feet move, in contrast to "Alpine" or heavier types of boots where the surface of the sole is partly rounded or similar measures have been used to compensate for the stiffness and thereby resulting restriction of movement.

When ski bindings of the toe-binding type are used, the binding is fastened by studs in the foot plate of the binding fitting into holes in the forward part of the sole of the ski-boot. The boot is clamped tightly to the binding by means of a clamp which presses down toward the outside edges of the forward part of the sole. The disadvantage of this tight clamping of the sole of the ski-boot is that the sole when it is being used is exposed to a constant bending stress in a particular area, namely in the area around the stud-holes, and it is this area in the sole which is most likely to break after a certain time of use. This form of attachment also means that the sole is held quite rigidly and hence hinders maximum freedom of movement and possibility of bending, in spite of the inherent flexibility of the sole.

In Norwegian Patent No. 124,665 an attempt has been made to remedy this problem by means of a special shaping of the ski-binding itself. In this connection the foot-plate of the toe-binding in the area right under the extreme front part of the sole is made to slope downwards in a forward direction in order to facilitate the forward swinging motion of the boot, and there is also a bulge-like elevation set into the bottom plate in the area around the studs. By means of this shaping a considerable degree of freedom of movement is achieved without any particular lifting of the sole being required at the place where the greatest stress occurs. At the same time, with this arrangement, the sole is hardly bent at all during use. The disadvantage with this known device, is however, that said device is bound to the shaping of the ski binding, while the problem itself really lies with the boot.

It is therefore a purpose of the present invention to provide a ski-boot sole which gives the above-mentioned advantages, i.e. that the boot is relieved of considerable strain at one place because of considerable bending stresses, at the same time as a certain "rolling" movement for the ski-boot sole is made possible in the ski binding, so that a greater freedom of movement is obtained, when skiing.

This is achieved by the forward end of the boot sole in the area in front of the stud holes on the underside being bevelled, preferably at about 30° in relation to the surface of the sole.

By means of this shaping, the leverage for the bending movement of the boot is considerably reduced, and the center of the bending movement will be located in the immediate proximity of the attachment point, so that the boot sole will be exposed to considerably less strain and thus will last for a much longer time. At the same time this shape makes the boot sole provide more comfortable action.

The invention will in the following be explained more in detail by means of a preferred embodiment which is depicted in the drawing, which shows in schematic form the forward part of a ski-boot where a ski binding is also indicated.

FIG. 1 a ski-boot in accordance with the invention seen from the side.

Figure 2:
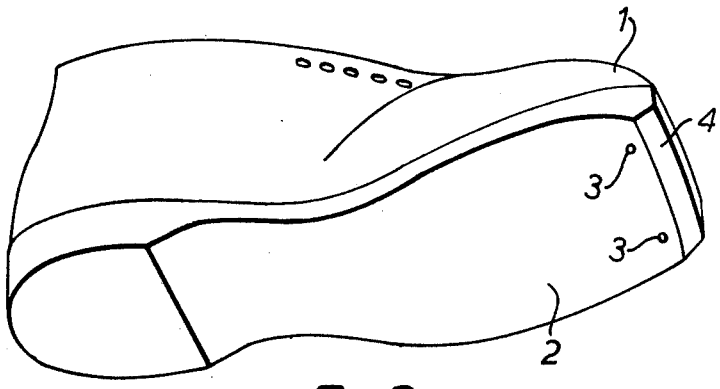
Figure 3:
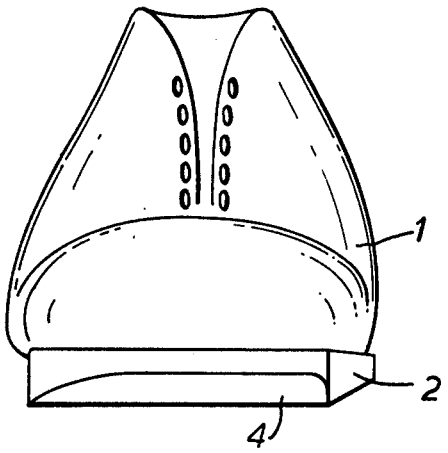
Figure 4:
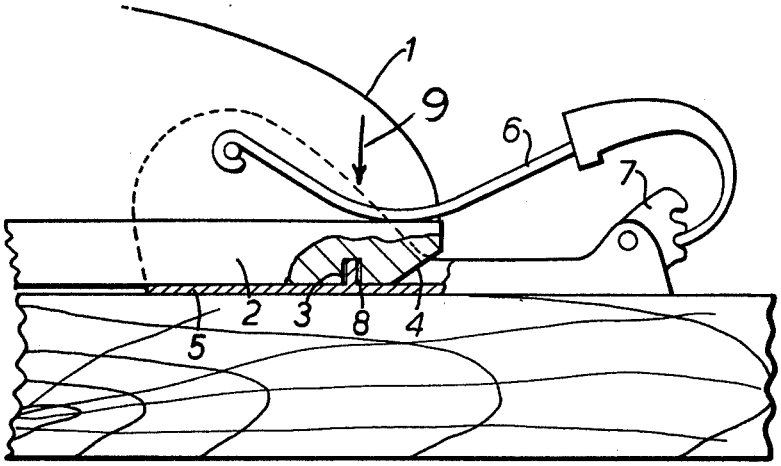

FIG. 2 a ski-boot according to FIG. 1 seen half from below,

FIG. 3 a ski-boot according to FIG. 1, seen from in front,

FIG. 4, a sketch of the toe part of the boot in a known binding with the right ear of the binding removed.

As shown in the figures, the ski-boot 1 has a sole 2 in the forward part of which are placed holes 3 in a manner known per se. In front of the holes 3 the under side of the boot sole is bevelled upward toward the front edge of the ski-boot, as indicated by 4. This bevelling preferably has an angle of approximately 30°, in relation to the sole.

The ski-boot as shown in FIG. 4 is placed on the bottom plate 5 of a ski binding 7, indicated with dotted lines, and the studs 8 from the bottom plate stick up into the holes 3. The boot or the sole of the boot is held firmly locked by means of a tension clamp 6. As the ski-binding is of a known type it is only indicated in FIG. 4. The place for the bending stress on the ski-boot sole with this attachment is indicated by an arrow 9. By means of the bevelling 4, the leverage is reduced when the boot sole is bent in action, so that the lever arm is shortened to the bevelling point. At the same time it is achieved that the boot sole can complete a rolling movement on the bottom plate 5 and thereby to a great degree the bending of the sole is also reduced, while at the same time a greater freedom of movement becomes possible.

Having described my invention, I claim:

1. In a cross-country ski-boot of the type including a front portion, a heel portion, and a relatively flexible sole to be used for cross-country skiing wherein the heel is repeatedly raised and lowered relative to the ski-binding during normal cross-country skiing activity, the sole including holes in its underside for engaging studs on a plate of a toe-binding type of ski-binding which retains the front portion against the plate and leaves the heel portion unrestrained in a manner enabling the heel portion to be repeatedly freely raised and lowered relative to the front portion and to the plate; the improvement wherein the front edge of the sole located in front of the holes is inclined upwardly and forwardly to permit a limited forward rolling motion of the boot as the heel portion is raised during normal cross-country skiing activity before appreciable bending of the sole occurs, to minimize being stresses in the front portion of the boot during raising and lowering of the heel portion.

2. A ski-boot according to claim 1 wherein the front edge of the sole is inclined by approximately 30°.

3. Cross-country skiing apparatus comprising a cross-country ski-boot including a front portion, a heel portion, a flexible sole, and apertures on the underside of the sole; and a ski-binding including a plate having upstanding studs to be received in said apertures and connecting means connecting the boot to the plate in a manner permitting the heel portion to be repeatedly raised and lowered relative to the front portion and to the plate during normal cross-country skiing activity; the connecting means including means retaining the front portion of the boot against the plate during normal cross-country skiing activities, the heel portion being unrestrained relative to the plate allowing the heel portion of the boot to be repeatedly freely raised and lowered relative to the plate during normal cross-country skiing activity; the front edge of the sole disposed in front of the apertures being inclined upwardly and forwardly to permit a limited forward rolling motion of the boot as the heel portion is raised during normal cross-country skiing activity before appreciable bending of the sole occurs, to minimize bending stresses in the front portion of the boot during raising and lowering of the heel portion.

* * * * *